US009283414B2

(12) United States Patent
Lemke et al.

(10) Patent No.: US 9,283,414 B2
(45) Date of Patent: Mar. 15, 2016

(54) SOLID PROPELLANT GAS GENERATOR, EXTINGUISHING DEVICE, METHOD FOR COOLING A FLOWING MIXTURE AND METHOD FOR EXTINGUISHING A FIRE

(71) Applicant: EADS Deutschland GmbH, Ottobrunn (DE)

(72) Inventors: Jens Lemke, Bremen (DE); Elizabeth Richter, Bremen (DE); Sebastian Schulz, Plochingen (DE)

(73) Assignee: Airbus Defence and Space GmbH, Ottobrunn (DE)

( * ) Notice: Subject to any disclaimer, the term of this patent is extended or adjusted under 35 U.S.C. 154(b) by 136 days.

(21) Appl. No.: 14/024,091

(22) Filed: Sep. 11, 2013

(65) Prior Publication Data

US 2014/0076586 A1 Mar. 20, 2014

(51) Int. Cl.

| | |
|---|---|
| ***A62C 35/00*** | (2006.01) |
| ***A62C 5/00*** | (2006.01) |
| ***A62C 99/00*** | (2010.01) |
| ***A62C 3/00*** | (2006.01) |
| ***E03C 1/084*** | (2006.01) |
| ***A62D 1/06*** | (2006.01) |
| ***F23D 14/04*** | (2006.01) |
| ***A62C 13/00*** | (2006.01) |
| ***A62C 13/20*** | (2006.01) |
| ***A62C 13/22*** | (2006.01) |

(52) U.S. Cl.

CPC . *A62C 5/004* (2013.01); *A62C 3/00* (2013.01); *A62C 5/006* (2013.01); *A62C 13/006* (2013.01); *A62C 13/20* (2013.01); *A62C 13/22* (2013.01); *A62C 99/0009* (2013.01); *A62C 99/009* (2013.01); *A62C 99/0018* (2013.01); *A62D 1/06* (2013.01); *E03C 1/084* (2013.01); *F23D 14/04* (2013.01)

(58) Field of Classification Search

CPC .... A62C 99/0018; A62C 5/006; A62C 5/004; A62C 99/009; A62C 99/0009; A62C 3/00; A62C 13/3006; A62C 13/20; A62C 13/22; E03C 1/084; F23D 14/04; A62D 1/06

USPC ..... 169/11, 12, 43, 46, 47, 84; 239/419.5, 239/428.5; 252/5

See application file for complete search history.

(56) References Cited

U.S. PATENT DOCUMENTS

| | | | | |
|---|---|---|---|---|
| 5,820,160 | A | 10/1998 | Johnson et al. | |
| 6,217,788 | B1 * | 4/2001 | Wucherer et al. | 252/5 |
| 6,622,801 | B1 * | 9/2003 | Rondino | 169/84 |
| 7,337,856 | B2 * | 3/2008 | Lund et al. | 239/419.5 |
| 2005/0115722 | A1 | 6/2005 | Lund et al. | |

FOREIGN PATENT DOCUMENTS

DE 31 22 897 A1 1/1983

OTHER PUBLICATIONS

German Office Action dated Jun. 18, 2013 (Six (6) pages).

* cited by examiner

*Primary Examiner* — Steven J Ganey

(74) *Attorney, Agent, or Firm* — Crowell & Moring LLP

(57) ABSTRACT

A solid propellant gas generator releases a flowing mixture from a solid propellant, separated from a surrounding area, into the surrounding area. The solid propellant gas generator includes a cooling system for cooling the flowing mixture. The cooling system has at least one feed device for feeding a gas from the surrounding area to the flowing mixture in order to mix the flowing mixture prior to entering into the surrounding area with the gas from the surrounding area.

14 Claims, 1 Drawing Sheet

Figure 1:
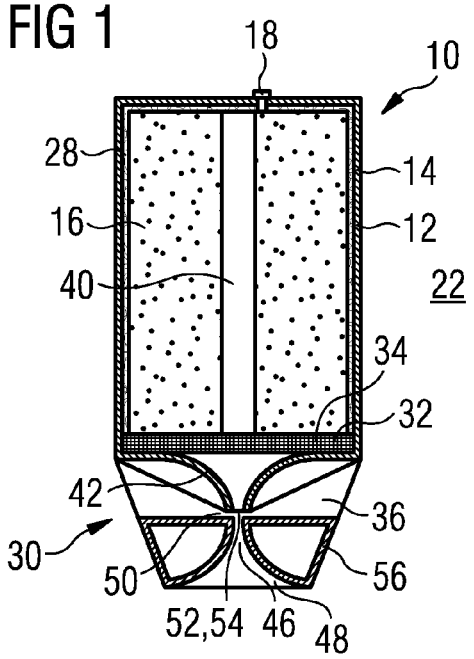

SOLID PROPELLANT GAS GENERATOR, EXTINGUISHING DEVICE, METHOD FOR COOLING A FLOWING MIXTURE AND METHOD FOR EXTINGUISHING A FIRE

BACKGROUND AND SUMMARY OF THE INVENTION

Exemplary embodiments of the present invention relate to a solid propellant gas generator, an extinguishing device, a method for cooling a flowing mixture and a method for extinguishing a fire.

Solid propellant gas generators are known in systems for extinguishing fires. In this case an extinguishing medium, which is present in the form of a solid propellant in a capsule, is ignited, so that the ignition process causes a flowing mixture of, for example, aerosols and gases, which are suitable for extinguishing or suppressing a fire, to develop from the solid propellant. In addition, the ignited solid propellant acts as a propellant for expelling the mixture from the capsule, in order to help extinguish or suppress the fire by means of the resulting increased kinetic energy of the mixture. An exemplary solid propellant gas generator for use in extinguishing fires is described in German patent document DE 31 22 897 A1.

The process of igniting the solid propellant, however, causes a significant rise in the temperature of the aerosols or rather the gases, so that the flowing mixture is released into the surrounding area at a high temperature. Such a situation should be avoided, especially if persons or temperature sensitive machines may be found in the outlet area of the flowing mixture.

Therefore, the solid propellant gas generators that are currently available on the market use cooling systems that cool the flowing mixture down to acceptable temperatures. Frequently solid thermal storage mediums, such as metal or ceramic, that can absorb the heat of the flowing mixture, are used for such cooling purposes. In that case the amount of thermal energy that can be stored is usually directly proportional to the weight of the storage medium.

However, the net effect is an increase in the weight of the solid propellant gas generators, so that they are less suitable for use in the design and construction of aircrafts.

Therefore, exemplary embodiments of the present invention are directed to an improved solid propellant gas generator.

A solid propellant gas generator is designed for releasing a flowing mixture from a solid propellant, separated from a surrounding area, into the surrounding area and comprises a cooling system for cooling the flowing mixture. In this case the cooling system has at least one feed device for feeding and mixing a gas from the surrounding area with the flowing mixture prior to entering into the surrounding area.

When the flowing mixture is released from the solid propellant gas generator, the flowing mixture absorbs energy and, in so doing, heats up too much. By supplying a gas, which has a lower energy content, from the surrounding area, the flowing mixture can be cooled to lower temperatures. In the case of the solid propellant gas generator according to the invention, the cooled gas from the surrounding area is mixed with the flowing mixture before the flowing mixture enters into the surrounding area. This arrangement reduces the risk of persons getting burned and/or the risk of temperature sensitive machines being damaged in the outlet region into the surrounding area. Accordingly, heavy cooling systems made of metal or ceramic for cooling purposes are not required. As a result, the solid propellant gas generator can also be used in the field of aeronautics.

Preferably the cooling system comprises an acceleration device for accelerating the flowing mixture, an introducing device for introducing the flowing mixture into the surrounding area and preferably a linear contact region of acceleration device and introducing device. In one advantageous embodiment the feed device is arranged at the contact region.

Thus, the kinetic energy, which the flowing mixture absorbs upon acceleration in the acceleration device, can be utilized through a reduction in the pressure for the purpose of drawing in cooling gas from the surrounding area by means of the feed device.

Preferably the feed device is arranged radially to the contact region. In particular, it is provided that the cross-section of the feed device tapers off from the surrounding area in the direction of the contact region.

Hence, the cooling gas from the surrounding area can be fed preferably essentially perpendicular to the flow direction of the flowing mixture, as a result of which the cooling gas mixes with the flowing mixture.

Due to the advantageous design of the feed device in the tapering form, the gas from the surrounding area is additionally accelerated in the direction of the flowing mixture, as a result of which an even better mixing of the mixture and gas is achieved.

Preferably the acceleration device connects an interior of the solid propellant gas generator with the contact region. At the same time it is provided that the cross-section of the acceleration device tapers off from the interior in the direction of the contact region.

Due to the advantageous design of the acceleration device the flowing mixture from the interior is accelerated in the direction of the contact region, where the mixture mixes with the cooling gas from the surrounding area.

Furthermore, the introducing device connects the contact region with the surrounding area. In this case the cross-section of the introducing device expands from the contact region in the direction of the surrounding area.

Due to the advantageous expansion of the introducing device, the previously accelerated flowing mixture is introduced into the surrounding area with dissimilar directional components and can mix there with the cooling gas from the surrounding area. The net effect is a drop in the temperature of the flowing mixture.

In a preferred embodiment the cooling system comprises a sealing mechanism for sealing off the interior from the surrounding area. In particular, the sealing mechanism is a water impermeable foil. This arrangement prevents contaminants from the surrounding area from penetrating into the cooling system or more specifically the solid propellant gas generator and, for example, clogging the cooling system.

It is most highly preferred that the feed device is arranged at the cooling system in the flow direction of the flowing mixture downstream of the sealing mechanism. Thus, on igniting the solid propellant the sealing mechanism can be blasted free by means of the flowing mixture that is generated. Therefore, it is even more preferred that the sealing mechanism be disposed in the region of the acceleration device, in particular at the place, where the flowing mixture reaches a maximum speed.

The cross-section of the cooling system is designed so as to taper off in the flow direction of the flowing mixture. Due to the advantageous outer shape of the cooling system, cool ambient air is conveyed along the tapering outer walls of the cooling system to the region, in which the flowing mixture enters into the surrounding area. Hence, it is possible to generate turbulence that enables the cool ambient air to mix with the flowing mixture.

Preferably a solid propellant storage device is provided for storing the solid propellant; and the housing of this solid propellant storage device is provided with a thermal insulation. With this solid propellant storage device the solid propellant can be separated from the surrounding area; and at the same time a thermal insulation is also on hand. During the ignition process this thermal insulation can ensure that the activating energy, generated by the ignition process, is used to generate the flowing mixture and is not released into the surrounding area. This minimizes both a rise in the temperature of the generator jacket and the risk of injuring persons and damaging material.

To this end an igniting device for igniting the solid propellant for generating the flowing mixture is provided.

In a preferred embodiment the solid propellant gas generator has a solid propellant for generating a gas and/or an aerosol and/or a gas-aerosol mixture, in particular for producing an extinguishing agent.

It is most highly preferred that a filter unit, in particular a metal mesh, is arranged between the cooling system and the solid propellant. With this arrangement it is possible to prevent the solid particles, which are produced when the solid propellant is ignited or when the solid propellant does not completely burn off, from clogging the cooling system, in that the solid particles are retained on the filter unit in the interior of the solid propellant gas generator.

An extinguishing device for extinguishing a fire comprises the solid propellant gas generator described above.

In a method for cooling a flowing mixture the following steps are carried out:

a) accelerating the flowing mixture;

b) feeding a cooling gas into the flowing mixture; and c) distributing the cooled flowing mixture into a surrounding area in such a way that additional cooling gas is supplied.

The acceleration of the flowing mixture, the supply of cooling gas and the distribution of the cooled flowing mixture is made possible by providing the solid propellant gas generator described above.

In this respect it is highly preferred that the flowing mixture be filtered.

In an advantageous method for extinguishing a fire preferably the steps a) to c) of the above described method are carried out.

BRIEF DESCRIPTION OF THE DRAWING FIGURES

Figure 2:
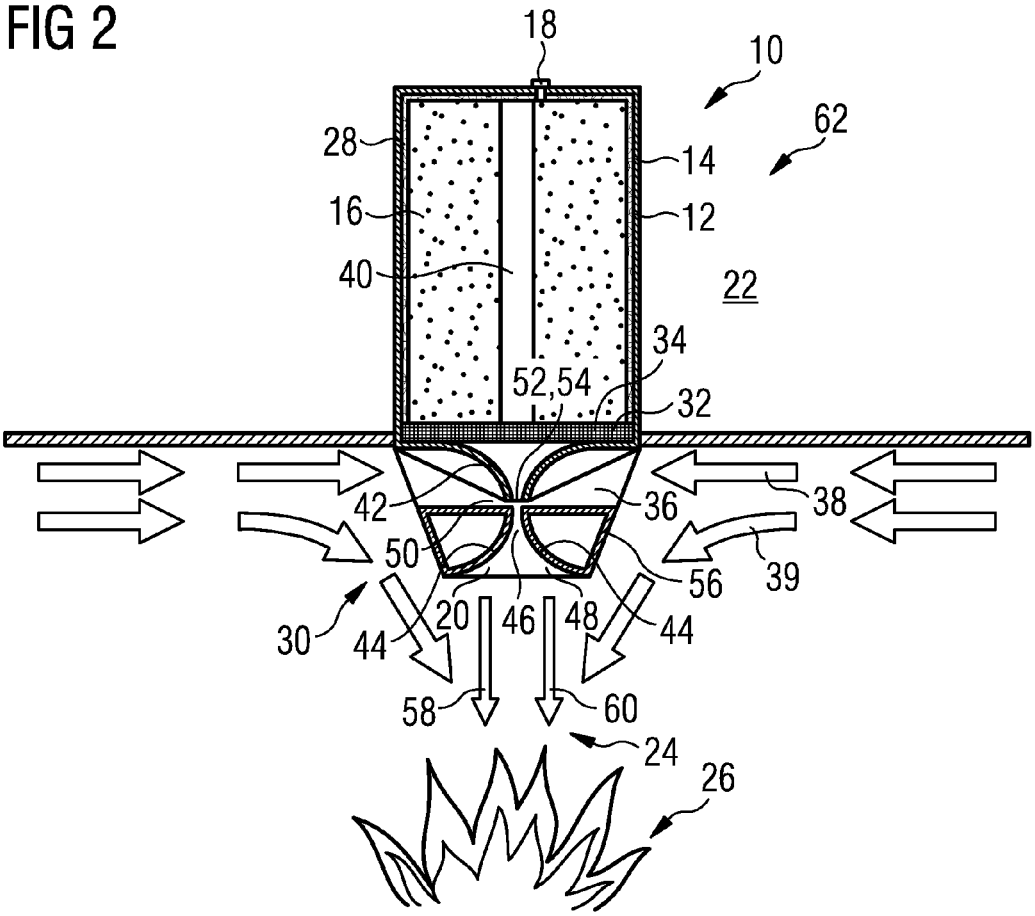

The invention is explained in detail below with reference to the accompanying drawings. The drawings show in FIG. 1 a solid propellant gas generator;

FIG. 2 flow conditions at and in a solid propellant gas generator from FIG. 1 after ignition.

DETAILED DESCRIPTION

FIG. 1 shows a solid propellant gas generator 10 with a solid propellant storage device 12 in the form of a housing 14, in which a solid propellant 16 is disposed. The housing 14 comprises an igniting device 18 for igniting the solid propellant 16.

When the solid propellant 16 is ignited by means of the igniting device 18, a flowing mixture 20 is released in the solid propellant gas generator 10; and this mixture issues from the housing 14 into a surrounding area 22 and can be used as the extinguishing agent 24 for extinguishing a fire 26, shown in FIG. 2.

In order to be able to use the activating energy, generated by the ignition process, in its entirety for igniting the solid propellant 16, the housing 14 has a thermal insulation 28.

Following the release of the flowing mixture 20, this flowing mixture passes through a cooling system 30, in which it is cooled down, and then exits into the surrounding area 22. First, however, the flowing mixture 20 is filtered by means of a filter unit 32, so that any larger particles that may be present in the flowing mixture 20 do not clog the cooling system 30. In the embodiment shown in FIG. 1, a metal mesh 34 is provided as the filter unit 32.

The cooling system 30 has a feed device 36, by means of which the gas 38 from the surrounding area 22, for example the air 39, can be fed to the flowing mixture 20, before it leaves the cooling system 30 and enters into the surrounding area 22.

The cooling system 30 is designed in such a way that it has an acceleration device 42, in which the flowing mixture 20 is accelerated, in the region, in which the flowing mixture 20 from an interior 40 of the housing 14 enters into the cooling system 30. In the acceleration device 42 the inner walls 44 of the cooling system 30 taper off, as seen in the flow direction, so that the acceleration device 42 forms a narrowing 46, in which the flowing mixture 20 exhibits a high speed due to the acceleration.

Connected to the acceleration device 42 is an introducing device 48, by means of which the accelerated flowing mixture 20 is introduced into the surrounding area 22.

The acceleration device 42 and the introducing device 48 are connected to each other in a contact region 50. In the embodiment of the solid propellant gas generator 10 depicted in FIG. 1, the introducing device 48 is formed in that the inner walls 44 expand away from each other in the flow direction.

The feed device 36 conveys the gas 38 from the surrounding area 22 in the contact region 50 between the acceleration device 42 and the introducing device 48 into the cooling system 30.

A sealing mechanism 52 (in the present example in the form of a water impermeable foil 54) is disposed in the flow direction above the feed device 36. This foil prevents contaminants from the surrounding area 22 from passing into the interior 40 of the housing 14 and, in so doing, clogging, for example, the cooling system 30, in particular, for example, at the narrowing 46.

In the present embodiment in FIG. 1 the contact region 50 has a linear construction. That is, the contact region connects the acceleration device 42 and the introducing device 48 to each other on a straight line, so that the maximum speed of the flowing mixture 20 prevails in the contact region 50. The feed device 36 is arranged radially to this linear contact region 50, so that the supplied gas 38 from the surrounding area 22 impinges on the flowing mixture 20 in essence with a perpendicular directional component. This arrangement allows the flowing mixture 20 and the gas 38 from the surrounding area 22 to mix. In addition, the feed device 36 tapers off in the flow direction of the supplied gas 38 and accelerates this gas 38 in such a way that the generation of turbulence upon impinging on the accelerated flowing mixture 20 in the cooling system 30 is reinforced.

The introducing device 48 expands from the contact region 50 in the flow direction of the flowing mixture 20, which is now cooled down, and, in so doing, distributes the flowing mixture 20 with dissimilar directional components into the surrounding area 22.

The outer walls 56 of the cooling system 30 also taper off in the flow direction of the flowing mixture 20.

This arrangement allows the air 39 of the surrounding area 22 to be conveyed, as shown by the large arrows in FIG. 2, preferably in the direction of the region, in which the flowing mixture 20 enters into the surrounding area 22. The net effect is additional mixing of the flowing mixture 20 with the cooler ambient air 39, so that the flowing mixture 20 cools down even more.

When the solid propellant 16 is ignited, aerosols are released in the interior 40 of the housing 14. These aerosols mix with the gas, which may be found in the interior 40, to form a gas-aerosol mixture 58. This gas-aerosol mixture 58 is mixed, as indicated by the small arrows in FIG. 2, with the cooling gas 38 from the surrounding area 22 and then issues into the surrounding area 22. The mixing of, for example, the air 39 with the gas-aerosol mixture 58 acts as an extinguishing agent 60, which can extinguish, for example, the fire 26 shown in FIG. 2. Hence, an extinguishing device 22, which can be used even in aerospace engineering due to its negligible weight, is formed by the particular design of the solid propellant gas generator 10.

In the above described solid propellant gas generator 10 a possible alternative cooling principle is proposed for a gas and/or an aerosol. Such an alternative cooling principle makes it possible to use the solid propellant gas generator 10 even in aircrafts and to replace the fire extinguishing systems that are currently used in the freight compartments of aircrafts.

The current solid propellant gas generators 10 are, in principle, too heavy for the construction of aircrafts. The reason lies in the heavy cooling system. This cooling system reduces the temperature of the generated gas or aerosols, before they leave the solid propellant gas generator 10, a feature that is necessary in order to prevent the risk of injuring persons and damaging machines. An alternative cooling principle can significantly reduce the weight of the solid propellant gas generator 10.

The current cooling systems of solid propellant gas generators 10 are based on the absorption of heat into a storage medium, such as metal or ceramic. The amount of heat that can be stored is, in principle, directly proportional to the weight of the storage medium. The result is that the solid propellant gas generators 10 are extremely heavy, because large amounts of heat are often generated by the solid propellant gas generator 10. Furthermore, it has been found that a storage-based cooling system can lead to a loss of extinguishing agent. Such a loss could decrease the efficiency of the solid propellant gas generator 10 and at the same time be associated with an increase in the weight of the solid propellant gas generator system.

Therefore, what is now proposed is to cool by mixing with the air 39 of the surrounding area 22. To this end it is provided that coarse particles be filtered out and that the extinguishing agent 60 be accelerated, for example, with a Laval nozzle. To this end the air 39 is drawn in and premixed with the extinguishing medium inside this exemplary Laval nozzle. An additional mixing at the outlet from the Laval nozzle is also possible.

In comparison to the current systems that are available on the market, the advantage of the proposed solid propellant gas generator 10 consists of the significantly reduced weight. This weight loss is achieved by the fact that with the air-cooled principle a thermal storage device does not have to be present in the solid propellant gas generator 10, because the air 39 absorbs the heat.

There is also the additional advantage that significantly fewer aerosol particles are lost due to the short straight outlet channel than in the currently existing cooling systems. Since the particles achieve the extinguishing effect predominantly by impinging on a fire 26 in a central manner, the loss incurred by a conventional cooling system leads to a reduction in the efficiency.

In summary, the solid propellant gas generator 10 is significantly lighter, more efficient and smaller than the currently existing systems.

A relatively new extinguishing system is the so-called aerosol or gas generators. This extinguishing method is based on various extinguishing effects, such as inhibition and inertization. In both cases the extinguishing medium is generated by igniting a quantity of solid propellant, the propellant charge. This process is associated with the development of a temperature that may present a particular concern for persons and machines. Current systems use solid storage mediums for cooling down to acceptable temperatures.

Due to the proposed alternative cooling principle of the present invention the weight of the generators is significantly reduced compared to that of solid propellant gas generators 10 with solid storage mediums.

As an alternative to a cooling system that stores heat, the cooling is achieved by mixing with air 39. The conveyance by means of, for example, a Laval nozzle, is suitable for this purpose. Due to this alternative cooling principle, the weight of the generators is drastically reduced.

The gas generating solid propellant 16 is positioned, as shown, for example, in FIG. 1, in a cylinder on a metal mesh 34. The metal mesh 34 serves as the filter in order to retain larger particles. Such an arrangement prevents the Laval nozzle, which is positioned so as to be connected thereto, from being clogged. As soon as the gas generating solid propellant 16 is ignited by means of, for example, an electric igniter, the solid propellant 16 begins to burn. The gas or aerosol that is generated flows through the mesh into the Laval nozzle, where it is accelerated. According to Bernoulli's energy equation, the static pressure decreases as the flow rate increases. A skillful selection (as shown in FIG. 1) of the nozzle geometry and the supply air channels allows the air 39 to be drawn into the nozzle in the course of conveyance; and this air mixes with the generated gas or aerosol. The net effect of this mixing is a significant reduction in the temperature of the extinguishing medium that is generated.

Moreover, a water impermeable protective foil is provided in order to prevent the gas generating solid propellant 16 from making contact with moisture. The generator jacket has internally a thermal insulation.

In this respect FIG. 1 shows the basic design of an air-cooled solid propellant gas generator.

Since the mixture of air and extinguishing agent leaves the Laval nozzle at a high speed, the net result is an additional mixing with the air 39 following the outflow of said air-extinguishing agent mixture. The flow conditions of the air-cooled solid propellant gas generator 10 can be seen in FIG. 2. In this case the arrows indicate the flow direction of the gases. The head of the generator is optimized with respect to flow in such a way that the result is a fast additional mixing of the air 39 and the extinguishing agent 60.

The net effect of the sequence presented above is a significant drop in the temperature of the generated extinguishing medium to temperatures that do not present a hazard. In summary it can be said that the generator is significantly lighter in weight, more efficient and smaller than those used in the currently existing systems.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMERALS

10 solid propellant gas generator
12 solid propellant storage device
14 housing
16 solid propellant
18 igniting device
20 flowing mixture
22 surrounding area
24 extinguishing agent
26 fire
28 thermal insulation
30 cooling system
32 filter unit
34 metal mesh
36 feed device
38 gas
39 air
40 interior
42 acceleration device
44 inner wall
46 narrowing
48 introducing device
50 contact region
52 sealing mechanism
54 foil
56 outer wall
58 gas-aerosol mixture
60 extinguishing agent
62 extinguishing device

The invention claimed is:

1. A solid propellant gas generator, comprising:

a housing containing a solid propellant, which is separated from a surrounding area, that is released as a flowing mixture into the surrounding area; and a cooling system configured to cool the flowing mixture, wherein the cooling system has at least one feed device configured to feed a gas from the surrounding area to the flowing mixture so that gas from the surrounding area mixes with the flowing mixture prior to entering into the surrounding area, wherein the cooling system comprises:

an acceleration device configured to accelerate the flowing mixture, an introducing device configured to introduce the flowing mixture into the surrounding area, and a linear contact region of acceleration device and introducing device, wherein the feed device is arranged at the linear contact region.

2. The solid propellant gas generator, as claimed in claim 1, wherein the feed device is arranged radially to the contact region, wherein a cross-section of the feed device tapers off from the surrounding area in a direction of the contact region.

3. The solid propellant gas generator, as claimed in claim 1, wherein the acceleration device connects an interior of the solid propellant gas generator with the contact region, a cross-section of the acceleration device tapers off from the interior in a direction of the contact region or the introducing device connects the contact region with the surrounding area, a cross-section of the introducing device expands from the contact region in a direction of the surrounding area.

4. The solid propellant gas generator, as claimed in claim 1, wherein a cross-section of the cooling system tapers off in a flow direction of the flowing mixture.

5. The solid propellant gas generator, as claimed in claim 1, wherein the housing includes thermal insulation.

6. The solid propellant gas generator, as claimed in claim 1, further comprising:

an igniting device configured to ignite the solid propellant to generate the flowing mixture.

7. The solid propellant gas generator, as claimed in claim 1, wherein the solid propellant generates a gas, an aerosol, or a gas-aerosol mixture as an extinguishing agent.

8. The solid propellant gas generator, as claimed in claim 7, further comprising:

a metal mesh filter unit arranged between the cooling system and the solid propellant.

9. A solid propellant gas generator, comprising a housing containing a solid propellant, which is separated from a surrounding area, that is released as a flowing mixture into the surrounding area; and a cooling system configured to cool the flowing mixture, wherein the cooling system has at least one feed device configured to feed a gas from the surrounding area to the flowing mixture so that gas from the surrounding area mixes with the flowing mixture prior to entering into the surrounding area, wherein the cooling system comprises a sealing mechanism configured to seal off the interior from the surrounding area, wherein the sealing mechanism is a water impermeable foil.

10. The solid propellant gas generator, as claimed in claim 9, wherein the feed device is arranged at the cooling system downstream of the sealing mechanism in a flow direction of the flowing mixture.

11. The solid propellant gas generator, as claimed in claim 9, further comprising:

an ignition device configured to ignite the solid propellant to generate the flowing mixture.

12. The solid propellant gas generator, as claimed in claim 9, wherein the solid propellant generates a gas, an aerosol, or a gas-aerosol mixture as an extinguishing agent.

13. The solid propellant gas generator, as claimed in claim 12, further comprising:

a metal mesh filter unit arranged between the cooling system and the solid propellant.

14. An extinguishing device for extinguishing a fire, the comprising:

a solid propellant gas generator, which includes a housing containing a solid propellant, which is separated from a surrounding area, that is released as a flowing mixture into the surrounding area; and a cooling system configured to cool the flowing mixture, wherein the cooling system has at least one feed device configured to feed a gas from the surrounding area to the flowing mixture so that gas from the surrounding area mixes with the flowing mixture prior to entering into the surrounding area, wherein the cooling system comprises:

an acceleration device configured to accelerate the flowing mixture, an introducing device configured to introduce the flowing mixture into the surrounding area, and a linear contact region of acceleration device and introducing device, wherein the feed device is arranged at the linear contact region.

* * * * *